US008522691B1

(12) United States Patent
Foege

(10) Patent No.: US 8,522,691 B1
(45) Date of Patent: Sep. 3, 2013

(54) APPARATUS AND METHOD FOR SUPPLEMENTAL COOLING

(71) Applicant: Electro-Motive Diesel, Inc., LaGrange, IL (US)

(72) Inventor: AAron Gamache Foege, Westmont, IL (US)

(73) Assignee: Electro-Motive Diesel, Inc., LaGrage, IL (US)

( * ) Notice: Subject to any disclaimer, the term of this patent is extended or adjusted under 35 U.S.C. 154(b) by 0 days.

(21) Appl. No.: 13/630,132

(22) Filed: Sep. 28, 2012

(51) Int. Cl.
*B61C 5/00* (2006.01)

(52) U.S. Cl.
USPC ..... 105/62.1; 105/62.2; 105/26.05

(58) Field of Classification Search
USPC ..... 105/62.1, 62.2, 26.05, 35, 49, 50, 105/61
See application file for complete search history.

(56) References Cited

U.S. PATENT DOCUMENTS

| | | | | |
|---|---|---|---|---|
| 4,037,526 | A | 7/1977 | Jaekle | |
| 4,698,761 | A | 10/1987 | Cooper et al. | |
| 5,375,580 | A * | 12/1994 | Stolz et al. | 123/527 |
| 5,392,741 | A * | 2/1995 | Uzkan | 123/41.13 |
| 5,425,338 | A * | 6/1995 | Gottemoller | 123/358 |
| 5,561,602 | A * | 10/1996 | Bessler et al. | 701/1 |
| 5,887,567 | A * | 3/1999 | White et al. | 123/294 |
| 6,649,292 | B2 * | 11/2003 | Breuer et al. | 429/415 |
| 7,011,904 | B2 * | 3/2006 | Bunker | 429/439 |
| 7,072,747 | B2 | 7/2006 | Armbruster et al. | |
| 7,098,779 | B2 * | 8/2006 | Pontius | 340/439 |
| 7,325,498 | B2 * | 2/2008 | Kumar et al. | 105/35 |
| 7,444,944 | B2 * | 11/2008 | Kumar et al. | 105/26.05 |
| 2005/0053814 | A1 * | 3/2005 | Imamura et al. | 429/22 |
| 2005/0206331 | A1 * | 9/2005 | Donnelly | 318/52 |
| 2005/0279242 | A1 * | 12/2005 | Maier et al. | 105/26.05 |
| 2006/0035120 | A1 * | 2/2006 | Sakai | 429/22 |
| 2006/0061307 | A1 * | 3/2006 | Donnelly | 318/108 |
| 2006/0093880 | A1 * | 5/2006 | Igarashi et al. | 429/22 |
| 2006/0266255 | A1 * | 11/2006 | Donnelly et al. | 105/61 |
| 2006/0266256 | A1 * | 11/2006 | Donnelly et al. | 105/61 |
| 2006/0283350 | A1 * | 12/2006 | Kumar et al. | 105/26.05 |
| 2007/0298298 | A1 * | 12/2007 | Ishigaki et al. | 429/24 |
| 2008/0031801 | A1 * | 2/2008 | Lackner et al. | 423/438 |
| 2008/0118800 | A1 * | 5/2008 | Devriendt et al. | 429/26 |
| 2008/0121136 | A1 * | 5/2008 | Mari et al. | 105/35 |
| 2008/0148993 | A1 * | 6/2008 | Mack | 105/35 |
| 2008/0210185 | A1 * | 9/2008 | Kubo et al. | 123/1 A |
| 2008/0250804 | A1 * | 10/2008 | Kubo et al. | 62/241 |
| 2008/0268313 | A1 * | 10/2008 | Hirayama | 429/26 |
| 2009/0035613 | A1 * | 2/2009 | Chikugo et al. | 429/13 |
| 2009/0087702 | A1 * | 4/2009 | Yonekura et al. | 429/13 |
| 2010/0030448 | A1 * | 2/2010 | Roth et al. | 701/103 |
| 2010/0087979 | A1 * | 4/2010 | Neusinger et al. | 701/22 |

* cited by examiner

*Primary Examiner* — Jason C Smith
(74) *Attorney, Agent, or Firm* — Baker Hostetler

(57) ABSTRACT

A supplemental cooling system for a mobile machine having a combustion engine fueled by a liquefied fuel gas is provided wherein the supplemental cooling system is activated when, or in anticipation of, the combustion engine encountering abnormal and/or temporary ambient conditions requiring supplemental cooling and wherein the supplemental cooling is provided by heat transfer from said liquefied fuel gas to a coolant fluid.

20 Claims, 1 Drawing Sheet

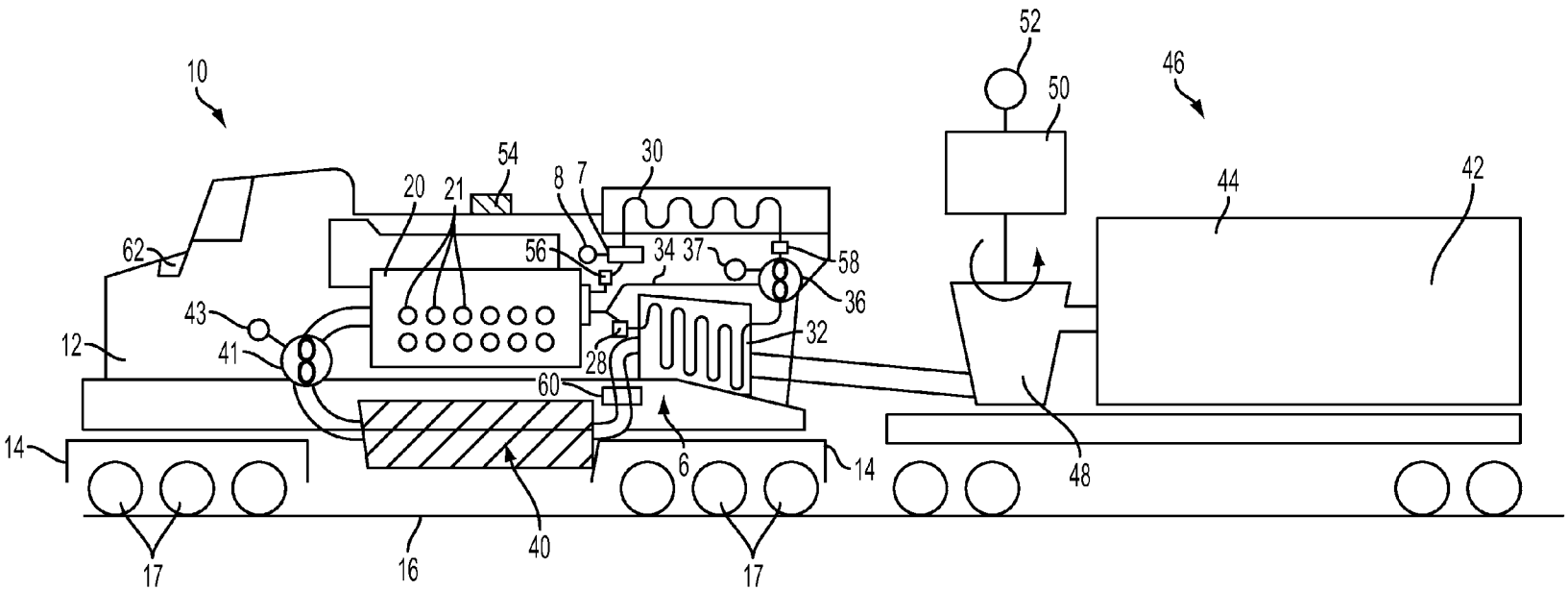
42
44
46
52
50
48
58
36
32
14
17
37
34
30
6
7
8
28
60
56
40
54
21
20
16
10
41
43
62
12
17
14

APPARATUS AND METHOD FOR SUPPLEMENTAL COOLING

TECHNICAL FIELD

The present disclosure relates generally to a cooling system, and more particularly, to a supplemental cooling system for use in connection with a combustion engine fueled by a liquefied fuel gas, such as liquefied natural gas (LNG), for use in abnormal operating conditions.

BACKGROUND

In response to the diminishing availability of petroleum based liquid fuels, such as gasoline, diesel fuel, jet fuel, etc., as well as for other reasons, liquefied fuel gasses, such as LNG, have seen increased use as alternative fuels for combustion engines. Simultaneously, combustion engines have been developed, and are currently being developed, which can efficiently utilize these alternative fuels. As such, the manufacturers and users of locomotives, over-the-road trucks, off-the-road trucks, boats, etc., as well as others, are continuously investigating combustion engines that efficiently utilize liquefied fuel gas as a combustion fuel.

These types of liquefied fuel gas combustion engines often operate in environments that can change dramatically within a relatively short period of time, particularly if such engines are used in mobile applications. For example, during a single trip between destinations, a locomotive can operate in an open environment and, at select times during the trip, in a closed environment (such as in a tunnel). When the locomotive operates in an open environment, it is generally provided with an adequate amount of relatively cool ambient air that may be used for both combustion and for cooling the combustion engine, as well as other heat-sensitive components, such as electronics, of the locomotive. However, when the locomotive operates in a more closed environment, such as a tunnel, the amount of available air useful for cooling purposes may be considerably reduced. Further, since the temperature of that air can be considerably higher than standard ambient air, the thermal capacity of that air for cooling purposes can be decreased significantly over "standard" ambient air. For this reason, in such closed environments, performance of a mobile machine, such as a locomotive, can be severely affected. Examples of issues that can arise include overheating of the engine and/or related electronics and/or other heat-sensitive equipment. Alternatively, a mobile machine may have to be de-rated from its actual "standard" operating capabilities in order to account for the diminished capabilities of that machine in the closed environments that may only account for a very small amount of actual operating time of that locomotive.

One attempt to improve cooling of a mobile machine having a combustion engine utilizing a liquefied fuel gas is described in U.S. Pat. No. 5,375,580 ("the '580 patent") of Stolz et al. that issued on Dec. 27, 1994. The '580 patent describes a combustion engine that is either supercharged or turbocharged, potentially in stages. Specifically, the '580 patent discusses the use of a liquefied fuel gas in an internal combustion engine to which compressed intake combustion air is supplied using, for example, a supercharger or turbocharger, and which is fueled with a liquefied fuel gas, such as, for example, liquefied natural gas (LNG), wherein the cold revaporized fuel gas is heat exchanged with the compressed intake combustion air to cool the compressed intake combustion air to improve efficiency and performance of the engine. This heat interchange between the heated intake air and the cold liquefied fuel gas warms the liquefied fuel gas from its cold state to a temperature that permits operation of the internal combustion engine and, simultaneously, cools the compressed intake air to a temperature that improves engine efficiency. However, the cooling system disclosed in the '580 patent is not necessarily useful in all situations, and particularly, situations such as those described herein wherein additional supplemental cooling is necessary due to the combustion engine utilizing a liquefied fuel gas being subject to temporary abnormal operating conditions.

Specifically, the cooling system described in the '580 patent is related to a cooling system for a combustion air charging system or after cooler for a turbocharger or supercharger. It does not deal with direct engine cooling, supplemental cooling, or cooling of heat-sensitive components such as electronics. Furthermore, the cooling system described in the '580 patent does not deal with specific instances of operation of the combustion engine wherein the standard operating conditions for the combustion engine, that the engine is generally rated for, change, due to, for example, the combustion engine travelling through a tunnel. As such, the cooling system described in the '580 patent may not be used to provide supplemental, although needed, cooling to cool the engine of a combustion engine when it encounters unusual ambient air conditions, such as when the combustion engine is being utilized in a locomotive travelling through a tunnel Finally, since the cooling system described in the '580 patent describes a system for cooling the air either entering a supercharger or turbocharger, between stages thereof, or as an aftercooler prior to the air entering the combustion chamber of the internal combustion engine, it does not disclose a method or an apparatus for use of the cooling capacity of a liquefied fuel gas to the components of the engine itself, or of other heat-sensitive components, much less to provide supplemental cooling when the combustion engine is being subjected to unusual or temporary ambient operating conditions.

SUMMARY

In one aspect, the disclosure is directed to a cooling system for a combustion engine utilizing a liquefied fuel gas, such as, for example, liquefied natural gas (LNG), liquefied petroleum gas (LPG), liquefied propane (LP), refrigerated liquid methane (RLM), etc. that may be subject to unusual and/or temporary ambient operating conditions. In such an aspect, the cooling system may include a heat exchanger in the combustion engine, a radiator configured to receive coolant from the combustion engine heat exchanger and transfer heat to ambient air passing through and/or over the radiator, a supplemental heat exchanger configured to receive coolant from the radiator and transfer heat to the liquefied fuel gas prior to the liquefied fuel gas entering an accumulator and/or the combustion engine for combustion, and a bypass loop. The cooling system may further include a first temperature sensor configured to generate a first signal indicative of a temperature of ambient air, and a controller in communication with a balance valve between the radiator and the supplemental heat exchanger and connected to the bypass loop to control the amount of coolant that is diverted through the supplemental heat exchanger versus being bypassed directly back to the combustion engine heat exchanger in order to achieve a desired coolant temperature prior to the coolant being recirculated back through the cooling system.

In another aspect, the disclosure is directed to a method of cooling a heat-sensitive component on a mobile machine having a combustion engine fueled by a liquefied fuel gas.

The method may include circulating coolant from the main coolant loop through a heat-sensitive component of the mobile machine, and directing coolant from the heat-sensitive component through a radiator and a supplemental heat exchanger. The method may also include activating a balance valve between the supplemental heat exchanger and the radiator in order to regulate the temperature of the coolant as it flows through the coolant loop including the heat-sensitive component, the radiator, the bypass loop, and the supplemental heat exchanger.

In another aspect, the disclosure is directed to a method of cooling a heat-sensitive component on a mobile machine having a combustion engine fueled by a liquefied fuel gas. The method may include circulating coolant through a main coolant loop through a heat-sensitive component of the mobile machine, and directing coolant from the heat-sensitive component through a radiator and a supplemental heat exchanger. The method may also include directing a controller to empty a gas accumulator for storing a liquefied fuel gas in gaseous form after it has passed through a supplemental heat exchanger and directing a controller on a pump for pumping liquefied fuel gas in liquid form from a storage tank through the supplemental heat exchanger and to the accumulator at an increased rate.

In another aspect, the disclosure is directed to providing supplemental cooling to a heat-sensitive component and/or a combustion engine on a locomotive fueled by a liquefied fuel gas in anticipation of the locomotive passing through a tunnel. In accordance with such an aspect, the locomotive may include a tunnel indicator that initiates a tunnel operation, whereby a controller may direct a pump and/or valve operably connected to a supplemental heat exchanger for the combustion engine and/or heat-sensitive component cooling system to provide higher than normal cooling fluid flow to the supplemental heat exchanger, and thus, higher than normal cooling of the combustion engine and/or heat-sensitive component prior to the locomotive entering the tunnel. Specifically, in such an aspect, the controller may activate a balance valve for a bypass loop between a radiator and a supplemental heat exchanger to achieve a desired coolant temperature generally lower than "standard" operating temperature and, or in connection therewith, the controller (or another controller) may direct the emptying of a gas accumulator for storing a liquefied fuel gas in gaseous form after it has passed through the supplemental heat exchanger while simultaneously directing a pump for pumping liquefied fuel gas in liquid form from a storage tank through the supplemental heat exchanger to the accumulator at a higher than "standard" rate. Regardless, in such an aspect, the pre-cooling of the combustion engine and/or heat-sensitive component serves to effectively increase the tolerance of the combustion engine and/or heat-sensitive component to thermal overload prior to actual temperature increase created by the tunnel thus preventing potential adverse consequences created thereby.

BRIEF DESCRIPTION OF THE DRAWINGS

FIG. 1 is a pictorial illustration of an exemplary embodiment of a cooling system in accordance with an aspect of the present disclosure.

DETAILED DESCRIPTION

FIG. 1 illustrates an exemplary embodiment of a cooling system 6 in accordance with an aspect of the present disclosure as utilized in a mobile machine 10, such as a locomotive, that includes a car body 12 supported at opposing ends by a plurality of trucks 14. Each truck 14 may be configured to engage a track 16 via a plurality of wheels 17. In the exemplary embodiment shown in FIG. 1, mobile machine 10 includes at least a first internal combustion engine 20 configured to combust a liquefied fuel gas having a heat exchanger 21 therein. Mobile machine 10 may also include power electronics 28 operatively supported by and included in the mobile machine 10.

As shown in FIG. 1, the cooling system 6 may generally include a radiator 30 located in and/or on the car body 12 so that it is in thermal contact with the ambient air, a supplemental heat exchanger 32, a bypass loop 34 and a balance valve 36, all of which are in coolant fluid communication with the heat exchanger 21 for the combustion engine 20. Additionally, in an aspect in accordance with the disclosure, the car body 12 may include a gas accumulator 40 for supplying gas fuel to the combustion engine 20 controlled by control valve 41 having controller 43. In such an aspect of the disclosure, cooling system 6 may utilize coolant such as water, glycol, a water/glycol mixture, a blended air mixture, or any other heat transferring fluid as known to those of ordinary skill in the art which may be pumped through the cooling system 6 by coolant pump 7 having controller 8. As will be apparent to a person of ordinary skill in the art, coolant pump 7 may be located practically anywhere in cooling system 6. In at least one aspect of the present disclosure, liquefied fuel gas 42, such as liquefied natural gas (LNG), may be stored in a storage tank 44 located on a tender car 46. The LNG may, in such an aspect, be stored cryogenically in the storage tank 44 and may be pumped to the supplemental heat exchanger 32 by a liquefied fuel gas pump 48 powered by a motor 50 having a controller 52.

In one aspect of the disclosure, balance valve 36 may be a proportional type valve having a valve element movable to regulate a flow of coolant and may be controlled by a controller 37. The valve element of balance valve 36 may be solenoid-operable to move between maximum cooling and bypass positions, as well as any number of positions in-between. In a maximum cooling position, balance valve 36 may permit substantially all of the coolant to flow through supplemental heat exchanger 32 prior to being diverted to the combustion engine 20 heat exchanger 21. In the bypass position, balance valve 36 may divert substantially all of the coolant flow away from the supplemental heat exchanger 32 directly to the combustion engine 20 heat exchanger 21 via bypass loop 34. Balance valve 36 may also include any number of non-discriminate intermediate positions between the maximum cooling position and the bypass condition. While balance valve 36 is described as being a proportional-type valve, a plurality of throttle-type valves (not shown) may alternatively be utilized as would be apparent to a person of ordinary skill in the art.

In use, in an aspect of the disclosure, an LNG fueled mobile machine 10 is normally cooled by radiator 30 by rejecting about 2400 KW of heat to the ambient air. When the mobile machine 10 encounters an abnormal, temporary increase in ambient air temperature, such as a tunnel, the radiator 30 is no longer able to reject heat to the atmosphere at that rate. Accordingly, a combustion engine 20 that might be rated at a certain level for normal operation must be de-rated to a level consistent with operation that would allow safe operation in abnormal, temporary conditions, such as tunnel operation. Thus, when a mobile machine 10, such as a locomotive, approaches an abnormal ambient air condition, the controller 52 controlling the motor 50 driving the liquefied fuel gas pump 48 (in liquid form) may slow the rate of pumping of liquefied fuel gas based upon the amount of fuel gas (in gaseous form) currently being stored in accumulator 40. Specifically, if the accumulator 40 is full (or more than half full) as the locomotive approaches the tunnel, the controller 52 will direct the motor 50 to slow or stop pump 48 so that the accumulator 40 will be evacuated by valve 41 prior to the locomotive entering the tunnel. Then, upon entering the tunnel, the controller 52 can direct motor 50 to a higher speed or "overload" rating, thereby providing the desired additional cooling through supplemental heat exchanger 32 increasing the cooling rate (e.g. 10× for 100% jacket water cooling) through the evaporation of the liquefied natural gas (in liquid form) in the supplemental heat exchanger 32.

Conversely, if upon approaching the tunnel, accumulator 40 is empty (or less than half full), then it may not be necessary to empty accumulator 40 prior to the locomotive entering the tunnel. In such a situation, as with above, the controller 52 controlling the motor 50 driving the liquefied fuel gas pump 48 (in liquid form) may go to a higher rating whenever the additional cooling from the supplemental heat exchanger 32 is needed. In either instance, in accordance therewith, balance valve 36 may be employed to balance the flow of coolant between the radiator 30 and combustion engine 20 heat exchanger 21 (through the bypass loop 34) and the supplemental heat exchanger 32. After cooling the coolant, the excess LNG fuel 42, now in gaseous form, may be stored in accumulator 40 for use in normal operation of mobile machine 10 combustion engine 20.

In another aspect of the disclosure, mobile machine 10 may be equipped with a cooling system 6 that is configured to cool another heat sensitive device, such as power electronics 28 of mobile machine 10. In additional aspects of the disclosure, controllers 8, 37, 43, and 52 may be single microprocessors or multiple microprocessors that include mechanisms for controlling an operation of cooling system 6, an in particular, operations of the coolant pump 7, valve 36, valve 41, and/or liquefied fuel gas pump 48. Numerous commercially available microprocessors can be configured to perform the functions of controllers 8, 37, 43, and 52. It should be appreciated that controllers 8, 37, 43, and 52 could readily be embodied in a general engine or machine microprocessor capable of controlling numerous engine and/or machine functions. Controllers 8, 37, 43, and 52 may include memories, secondary storage devices, processors, and any other components necessary for running an application as is known by those of ordinary skill in the art. Various other circuits may be associated with controllers 8, 37, 43, and 52 such as power supply circuitry, sensor circuitry, signal conditioning circuitry, solenoid driver circuitry, and other types of circuitry.

Controllers 8, 37, 43, and 52 may rely on input from one or more sensors during regulation of cooling system 6. In at least one aspect of the disclosure herein, controllers 8, 37, 43, and 52 may rely on at least one sensor 54 configured to measure an ambient air temperature outside of mobile machine 10, at least one sensor 56 configured to measure a temperature of coolant flowing from the combustion engine 20 heat exchanger 21, at least one sensor 58 configured to measure the temperature of coolant fluid flowing from radiator 30 to bypass loop 34 and/or supplemental heat exchanger 32, and at least one sensor 60 configured to measure the temperature of the liquefied fuel gas 42 after it has left supplemental heat exchanger 32, although any number and types of sensors may be utilized. Sensors 54, 56, 58, and 60 may embody, for example, temperature sensors configured to generate signals indicative of temperature and may direct corresponding signals to controllers 8, 37, 43, and 52 as is known to those of ordinary skill in the art.

In another aspect of the disclosure, the mobile machine 10 may be equipped with a tunnel indicator 62 that initiates a tunnel operation, for example one or two miles prior to the locomotive entering the tunnel. Consistent with that aspect of the disclosure, upon receiving indication of an upcoming tunnel, controller 43 may direct valve 41 to empty accumulator 40. In accordance therewith, controller 52 may direct motor 50 operably connected to liquefied fuel gas pump 48 to increase the flow of liquefied fuel gas 42 through supplemental heat exchanger 32 to accumulator 40. Also in accordance therewith, controller 37 may direct balance valve 36 to direct additional coolant flow through supplemental heat exchanger 32 thereby providing additional cooling to combustion engine 20 through heat exchanger 21 and/or power electronics 28 prior to the tunnel being reached.

INDUSTRIAL APPLICABILITY

The present disclosure relates to an internal combustion engine 20 which is fueled with a liquefied fuel gas (LFG) 42, such as, for example, liquefied petroleum gas (LPG), liquefied propane (LP), refrigerated liquid methane (RLM), or liquefied natural gas (LNG). The present disclosure is generally applicable to combustion engines utilizing any gaseous fuel that can be stored as a liquid at pressures at or below about 200 psig (14 bar-g) and which can achieve adiabatic expansion temperatures of below about 50.degree. F. (10.degree. C.) from such storage pressures. Such internal combustion engines may be used in powering many devices, either stationary or moving. Commonly, such internal combustion engines are used also for locomotive power for transport vehicles such as cars, trucks, buses, railroad locomotives, and ship propulsion. Such internal combustion engines may also be used with stationary power plants, such as emergency power generators.

Specifically, this disclosure relates to a method and apparatus for providing supplemental cooling to an internal combustion engine 20 through heat exchanger 21 and/or other heat-sensitive equipment, such as power electronics 28, wherein the internal combustion engine 20 is fueled with a liquefied fuel gas 42 as discussed above. Specifically, the present disclosure is particularly useful in supplying such supplemental cooling wherein the internal combustion engine 20 occasionally encounters unusual and/or temporary conditions where the ambient air temperature and/or intake air temperature is higher than the ambient air temperature the combustion engine generally experiences and/or is rated for. Specifically, the disclosed cooling system 6 may use supplemental cooling capabilities provided by cryogenically stored liquefied fuel gas 42 through the use of a supplemental heat exchanger 32 wherein the cooling system 6 is activated in response to an abnormal ambient air condition, such as is caused by a locomotive entering a tunnel. In another aspect, the disclosure is directed to providing supplemental cooling to a heat-sensitive component and/or a combustion engine 20 on a locomotive fueled by a liquefied fuel gas 42 in anticipation of the combustion engine 20 and/or heat-sensitive component encountering an abnormal, temporary, higher-than-normal, ambient air condition, such as a locomotive passing through a tunnel.

In accordance with an aspect of the disclosure, the supplemental cooling provided by the disclosed supplemental cooling system and method may be 160 KW or more. As will be apparent to those of ordinary skill in the art, the amount of supplemental cooling achievable consistent with an aspect of the disclosure is determined by size of the motor 50 and liquefied fuel gas pump 48 combination, as well as the size of the accumulator 40. More specifically, it is within the scope of the disclosure that two pumps 48 and motors 50 be utilized, for redundancy purposes, and, if both were run in tandem, that supplemental cooling could be doubled to 320 KW or more. Of course, depending on the fuel needs of the internal combustion engine 20, the size of the accumulator 40 may become the limiting parameter for additional supplemental cooling. In such an architecture, and presuming the LFG 42 is stored at approximately 500 bar, every minute of supplemental cooling in accordance with the disclosure should require approximately 8.5 gallons of accumulator 40 space. Accordingly, in order to provide supplemental cooling at a rate of approximately 160 KW for 10 minutes of combustion engine 20 running time, an approximately 85 gallon accumulator 40 would be needed. Similarly, to provide cooling for 20 minutes at approximately the same rate, an approximately 170 gallon accumulator 40 would be needed. As such, as should be apparent to a person of ordinary skill in the art, accumulator 40 size may be manipulated (as well as liquefied fuel gas pump 48 and motor 50 size) in order to achieve the desired amount of available supplemental cooling (subject to the fueling needs of the internal combustion engine 20).

The disclosed cooling system 6 may provide an efficient mechanism for providing supplemental cooling of a mobile machine 10 during temporary environmental extremes. For example, the disclosed cooling system 6 may provide more effective cooling during tunnel conditions by reducing heat increases and thus allowing lower-rated locomotives to be generally used thereby resulting in cost savings.

It will be apparent to those skilled in the art that various modifications and variations can be made to the disclosed cooling system 6 without departing from the scope of the disclosure. Other embodiments of the cooling system 6 will be apparent to those skilled in the art from consideration of the specification and practice of the cooling system disclosed herein. It is intended that the specification and examples be considered as exemplary only, with a true scope of the disclosure being indicated by the following claims and their equivalents

What is claimed is:

1. A supplemental cooling system for an internal combustion engine fueled by a liquefied fuel gas comprising:

an internal combustion engine configured to combust liquefied fuel gas and having a heat exchanger in thermal contact therewith;

a storage tank configured to store liquefied fuel gas therein in liquid form;

a supplemental heat exchanger;

a radiator in thermal contact with ambient air;

an accumulator configured to store liquefied fuel gas in gaseous form therein;

a balance valve, having a controller, fluidly located between said radiator and said supplemental heat exchanger;

a bypass loop fluidly connected to said balance valve;

a coolant fluid;

a sensor configured to measure ambient air temperature;

wherein said internal combustion engine heat exchanger, said radiator and said supplemental heat exchanger are connected in a fluid loop for the flow of said coolant fluid and whereby said bypass loop fluidly bypasses said supplemental heat exchanger in connecting with said internal combustion engine heat exchanger;

wherein said storage tank is fluidly connected to said accumulator through said supplemental heat exchanger;

wherein during normal operation said coolant fluid is heated by said combustion engine and cooled by heat transfer with ambient air through said radiator; and wherein, in response to an abnormal, temporary increase in ambient air temperature, said controller directs said valve to direct increased coolant fluid flow from said radiator to said supplemental heat exchanger.

2. The supplemental cooling system of claim 1 further comprising a liquefied fuel gas pump having a controller configured to pump liquefied fuel gas from said storage tank through said supplemental heat exchanger to said accumulator.

3. The supplemental cooling system of claim 2 wherein, in response to an abnormal, temporary increase in ambient air temperature said liquefied fuel gas pump controller is directed to increase a flow of liquefied fuel gas from said storage tank through said supplemental heat exchanger to said accumulator.

4. The supplemental cooling system of claim 1 wherein said internal combustion engine is fueled by liquefied natural gas.

5. The supplemental cooling system of claim 1 further including a heat-sensitive component fluidly connected to said supplemental heat exchanger.

6. The supplemental cooling system of claim 5 wherein said heat-sensitive component is power electronics.

7. The supplemental cooling system of claim 1 further including a sensor configured to measure temperature of said coolant fluid flowing away from said internal combustion engine heat exchanger.

8. The supplemental cooling system of claim 1 further including a sensor configured to measure temperature of said coolant fluid flowing away from said radiator.

9. The supplemental cooling system of claim 1 wherein said supplemental cooling system is located in a railroad locomotive.

10. The supplemental cooling system of claim 9 further comprising a tunnel indicator configured to indicate an approaching tunnel.

11. A method for providing supplemental cooling to an internal combustion engine fueled by a liquefied fuel gas comprising the steps of:

providing an internal combustion engine configured to combust liquefied fuel gas and having a heat exchanger in thermal contact therewith;

providing a storage tank configured to store liquefied fuel gas therein in liquid form;

providing a supplemental heat exchanger;

providing a radiator in thermal contact with ambient air;

providing an accumulator configured to store liquefied fuel gas in gaseous form therein;

providing a balance valve, having a controller, fluidly located between said radiator and said supplemental heat exchanger;

providing a bypass loop fluidly connected to said balance valve;

providing a coolant fluid;

providing a sensor configured to measure ambient air temperature;

connecting said internal combustion engine heat exchanger, said radiator and said supplemental heat exchanger in a coolant fluid loop and connecting said bypass loop fluidly around said supplemental heat exchanger through said balance valve for the flow of said coolant fluid such that said coolant fluid, in normal operation, is heated by said combustion engine and cooled by heat transfer with ambient air through said radiator;

and wherein, in response to an abnormal, temporary increase in ambient air temperature, directing said controller to open said balance valve such that coolant fluid flow from said radiator to said supplemental heat exchanger is increased and coolant fluid flow through said bypass loop is decreased.

12. The method of claim 11 further comprising the steps of providing a liquefied fuel gas pump having a controller for pumping liquefied fuel gas from said storage tank through said supplemental heat exchanger to said accumulator and in response to an abnormal, temporary increase in ambient air temperature as sensed by said ambient air temperature sensor, directing said liquefied fuel gas pump controller to increase a flow of liquefied fuel gas from said storage tank through said supplemental heat exchanger to said accumulator.

13. The method of claim 11 further comprising the steps of providing a coolant pump having a controller for pumping coolant fluid through said coolant fluid loop and in response to an abnormal, temporary increase in ambient air temperature as sensed by said ambient air temperature sensor, directing said coolant pump controller to increase a flow of coolant fluid through the coolant fluid loop.

14. The method of claim 11 further comprising the step of fluidly connecting an additional heat-sensitive component to said supplemental heat exchanger.

15. The method of claim 11 wherein said heat-sensitive component is selected to be power electronics.

16. A railroad locomotive comprising:

a car body;

a plurality of trucks supporting the car body, the trucks having wheels thereon;

an internal combustion engine configured to combust liquefied fuel gas and having a heat exchanger in thermal contact therewith;

a storage tank configured to store liquefied fuel gas therein in liquid form;

a supplemental heat exchanger;

a radiator in thermal contact with ambient air;

an accumulator configured to store liquefied fuel gas in gaseous form therein;

a balance valve, having a controller, fluidly located between said radiator and said supplemental heat exchanger;

a bypass loop fluidly connected to said balance valve;

a coolant fluid;

a sensor configured to measure ambient air temperature;

wherein said internal combustion engine heat exchanger, said radiator and said supplemental heat exchanger are connected in a fluid loop for the flow of said coolant fluid and whereby said bypass loop fluidly bypasses said supplemental heat exchanger in connecting with said internal combustion engine heat exchanger;

wherein said storage tank is fluidly connected to said accumulator through said supplemental heat exchanger;

wherein during normal operation said coolant fluid is heated by said combustion engine and cooled by heat transfer with ambient air through said radiator; and wherein, in response to an abnormal, temporary increase in ambient air temperature, said controller directs said valve to direct increased coolant fluid flow from said radiator to said supplemental heat exchanger.

17. The locomotive of claim 16 further comprising a liquefied fuel gas pump having a controller configured to pump liquefied fuel gas from said storage tank through said supplemental heat exchanger to said accumulator.

18. The locomotive of claim 17 wherein, in response to an abnormal, temporary increase in ambient air temperature said liquefied fuel gas pump controller is directed to increase a flow of liquefied fuel gas from said storage tank through said supplemental heat exchanger to said accumulator.

19. The locomotive of claim 17 further comprising a tunnel indicator for alerting at least one controller of an approaching tunnel.

20. The locomotive of claim 19 wherein, in response to an indication of an approaching tunnel, said liquefied fuel gas pump is directed to pump liquefied fuel gas from said storage tank to said accumulator at a lower than normal rate.

* * * * *